US010180091B2

(12) United States Patent
Ishihara et al.

(10) Patent No.: US 10,180,091 B2
(45) Date of Patent: Jan. 15, 2019

(54) BREATHER APPARATUS FOR ENGINE

(71) Applicant: c/o SUZUKI MOTOR CORPORATION, Hamamatsu-Shi, Shizuoka-Ken (JP)

(72) Inventors: Yasuomi Ishihara, Hamamatsu (JP); Hideto Nakamura, Hamamatsu (JP)

(73) Assignee: SUZUKI MOTOR CORPORATION (JP)

( * ) Notice: Subject to any disclaimer, the term of this patent is extended or adjusted under 35 U.S.C. 154(b) by 33 days.

(21) Appl. No.: 15/388,692

(22) Filed: Dec. 22, 2016

(65) Prior Publication Data

US 2017/0183993 A1 Jun. 29, 2017

(30) Foreign Application Priority Data

Dec. 25, 2015 (JP) ..... 2015-253051

(51) Int. Cl.

| | |
|---|---|
| ***F01M 13/04*** | (2006.01) |
| ***B63H 20/00*** | (2006.01) |
| ***F01L 1/053*** | (2006.01) |
| ***F01M 13/00*** | (2006.01) |
| ***F02B 75/00*** | (2006.01) |

(Continued)

(52) U.S. Cl.

CPC ..... *F01M 13/04* (2013.01); *B63H 20/001* (2013.01); *F01L 1/053* (2013.01); *F01M 13/0011* (2013.01); *F02B 61/045* (2013.01); *F02B 75/007* (2013.01); *F01M 11/02* (2013.01); *F01M 2013/0488* (2013.01)

(58) Field of Classification Search

CPC ..... F01M 13/0011; F01M 13/04; F01M 2013/0488; F01M 11/08; F01M 13/00; F01M 13/022; F01M 2013/0461; F01M 11/02; F02B 61/045; F02B 75/007

USPC ..... 123/572–574, 41.86, 195 HC, 196 W

See application file for complete search history.

(56) References Cited

U.S. PATENT DOCUMENTS 4,404,936 A * 9/1983 Tatebe ..... F01M 13/00 123/196 R
4,470,389 A * 9/1984 Mitadera ..... F01M 13/00 123/196 CP (Continued)

FOREIGN PATENT DOCUMENTS

JP 2000045747 A 2/2000
JP 2000045749 A * 2/2000

*Primary Examiner* — Marguerite McMahon
*Assistant Examiner* — Tea Holbrook
(74) *Attorney, Agent, or Firm* — Barnes & Thornburg LLP

(57) ABSTRACT

A breather apparatus for an engine includes a breather chamber, one side portion and other side portion of the breather chamber, and a bottom face of the other side portion. The breather chamber is formed, along substantially half a circumference of a cylinder bore, in a cylinder block. The one side portion of the breather chamber is provided with a blow-by gas introduction hole leading blow-by gas in the crank chamber to the breather chamber and a one-way valve opening and closing the blow-by gas introduction hole. The other side portion of the breather chamber has a pipe connection hole connecting a breather pipe to the breather chamber and with a breather oil return passage. The bottom face of the other side portion projects into the crank chamber to a level lower than a bottom face of the one side portion.

7 Claims, 8 Drawing Sheets

(51) Int. Cl.
*F02B 61/04* (2006.01)
*F01M 11/02* (2006.01)

(56) References Cited

U.S. PATENT DOCUMENTS 4,549,520 A * 10/1985 Tamba ..... F01M 13/0011 123/572
4,569,323 A * 2/1986 Okumura ..... F01M 13/0416 123/41.86
4,602,595 A * 7/1986 Aoki ..... F01M 13/0416 123/41.86
4,727,834 A * 3/1988 Isaka ..... F01M 9/06 123/196 CP
4,881,510 A * 11/1989 Etoh ..... F01M 9/10 123/196 W
5,383,440 A * 1/1995 Koishikawa ..... F01M 13/022 123/196 W
5,474,035 A * 12/1995 Ming ..... F01M 13/023 123/41.86
5,794,602 A * 8/1998 Kimura ..... F01M 13/04 123/572
6,010,314 A * 1/2000 Kobayashi ..... F04B 27/109 417/222.2
6,021,766 A * 2/2000 Maeda ..... F01M 13/0416 123/573
6,035,836 A * 3/2000 Watanabe ..... F02B 61/045 123/572
6,899,091 B2 * 5/2005 Akiyama ..... F01M 13/04 123/41.86
8,171,922 B2 * 5/2012 Tanaka ..... F02M 25/06 123/572
8,256,405 B2 * 9/2012 Atkinson ..... F01M 13/022 123/195 HC
8,893,690 B2 * 11/2014 Efta ..... F01M 13/0011 123/41.86
2002/0046743 A1 * 4/2002 Moren ..... F01M 13/022 123/572
2003/0089352 A1 * 5/2003 Yoneyama ..... F01M 13/04 123/572
2005/0229893 A1 * 10/2005 Miyake ..... F01M 1/04 123/195 HC
2007/0251512 A1 * 11/2007 Wallington ..... F02M 25/06 123/572
2009/0308365 A1 * 12/2009 Atkinson ..... F01M 13/022 123/573

* cited by examiner

BREATHER APPARATUS FOR ENGINE

CROSS-REFERENCE TO RELATED APPLICATIONS

This application claims the benefit of priority of Japanese Patent Application No. 2015-253051, filed Dec. 25, 2015, the entire contents of which are incorporated herein by reference.

BACKGROUND OF THE INVENTION

Field of the Invention

The present invention relates to an engine breather apparatus configured to lead blow-by gas in a crank chamber to an intake system.

Description of the Related Art

Patent Document 1 (Japanese Patent Laid-Open No. 2000-45747) discloses a breather apparatus for a four-stroke OHV engine, where a breather chamber is formed on a top face of a cylinder block along substantially half a circumference of a cylinder bore, a cylinder and a crankcase are constructed integrally in the cylinder block, the cylinder bore extends horizontally in the cylinder, and the crankcase makes up a crank chamber.

However, with the breather apparatus described in Patent Document 1, volume and shape of the breather chamber may be restricted depending on the type and arrangement of valve device, which could disable the breather apparatus from delivering sufficient gas/liquid separation performance. For example, in an engine of the form (vertical form) in which a crankshaft is placed in a vertical direction, if the valve device is placed on a side of the cylinder rather than below the cylinder, the valve device may make it impossible to secure a sufficient volume of the breather chamber, which could lead to degradation in the gas/liquid separation performance of the breather apparatus.

SUMMARY OF THE INVENTION

The present invention has been made in consideration of the above circumstances, and an object of the present invention is to provide an engine breather apparatus which allows volume of a breather chamber to be increased and makes it possible to improve gas/liquid separation performance of the breather apparatus.

The above and other objects can be achieved according to the present invention by providing, in one aspect, a breather apparatus for an engine includes a breather chamber, one side portion of the breather chamber, other side portion of the breather chamber, and a bottom face of the other side portion. The engine includes a cylinder and a crankcase. A cylinder bore whose central axis extends in a horizontal direction is formed in the cylinder. A crank chamber configured to house a crankshaft in a vertical direction is formed in the crankcase. The breather chamber is formed, along substantially half a circumference of the cylinder bore, in a cylinder block in which the cylinder and the crankcase are constructed integrally. The one side portion of the breather chamber in a circumferential direction of the cylinder bore is provided with a blow-by gas introduction hole configured to lead blow-by gas in the crank chamber to the breather chamber and a one-way valve configured to open and close the blow-by gas introduction hole along with pulsating pressure in the crank chamber. The other side portion of the breather chamber in the circumferential direction of the cylinder bore is provided with a pipe connection hole configured to connect a breather pipe communicated with an intake system to the breather chamber, and is provided with a breather oil return passage configured to return oil separated in the breather chamber to the crank chamber. The bottom face of the other side portion of the breather chamber is formed so as to project into the crank chamber to a level lower than a bottom face of the one side portion of the breather chamber.

If a bottom face of one side portion of a breather chamber in a circumferential direction of a cylinder bore is approximately level with an intake cam and exhaust cam of a cam shaft, splashes (oil droplets) of lubricating oil in a crank chamber attach to the bottom face of the one side portion of the breather chamber by flying from the intake cam and exhaust cam under action of centrifugal force and tend to flow into the breather chamber through a blow-by gas introduction hole and the like. Thus, the bottom face of the one side portion of the breather chamber needs to be formed at a level higher than the intake cam and exhaust cam.

In contrast, on the other side portion of the breather chamber in the circumferential direction of the cylinder bore, where splashes from the intake cam and exhaust cam are blocked by a cylinder projecting into the crank chamber, even if a bottom face of the other side portion is extended to a position approximately level with or lower than the intake cam and exhaust cam, splashes (oil droplets) of lubricating oil in the crank chamber will not attach to the bottom face of the other side portion of the breather chamber. Thus, if the bottom face of the other side portion of the breather chamber is made to project into the crank chamber to a level lower than the bottom face of the one side portion of the breather chamber, volume of a breather chamber can be increased as a whole and consequently gas/liquid separation performance of the breather apparatus can be improved.

The nature and further characteristic features of the present invention will be described hereinafter in the following descriptions made with reference to the accompanying drawings, and the other advantages effects and functions of the present invention will be also made clear hereinafter.

DETAILED DESCRIPTION

Hereinbelow, a description will be given of a breather apparatus for engine according to embodiments of the present invention with reference to the drawings.

Figure 1:
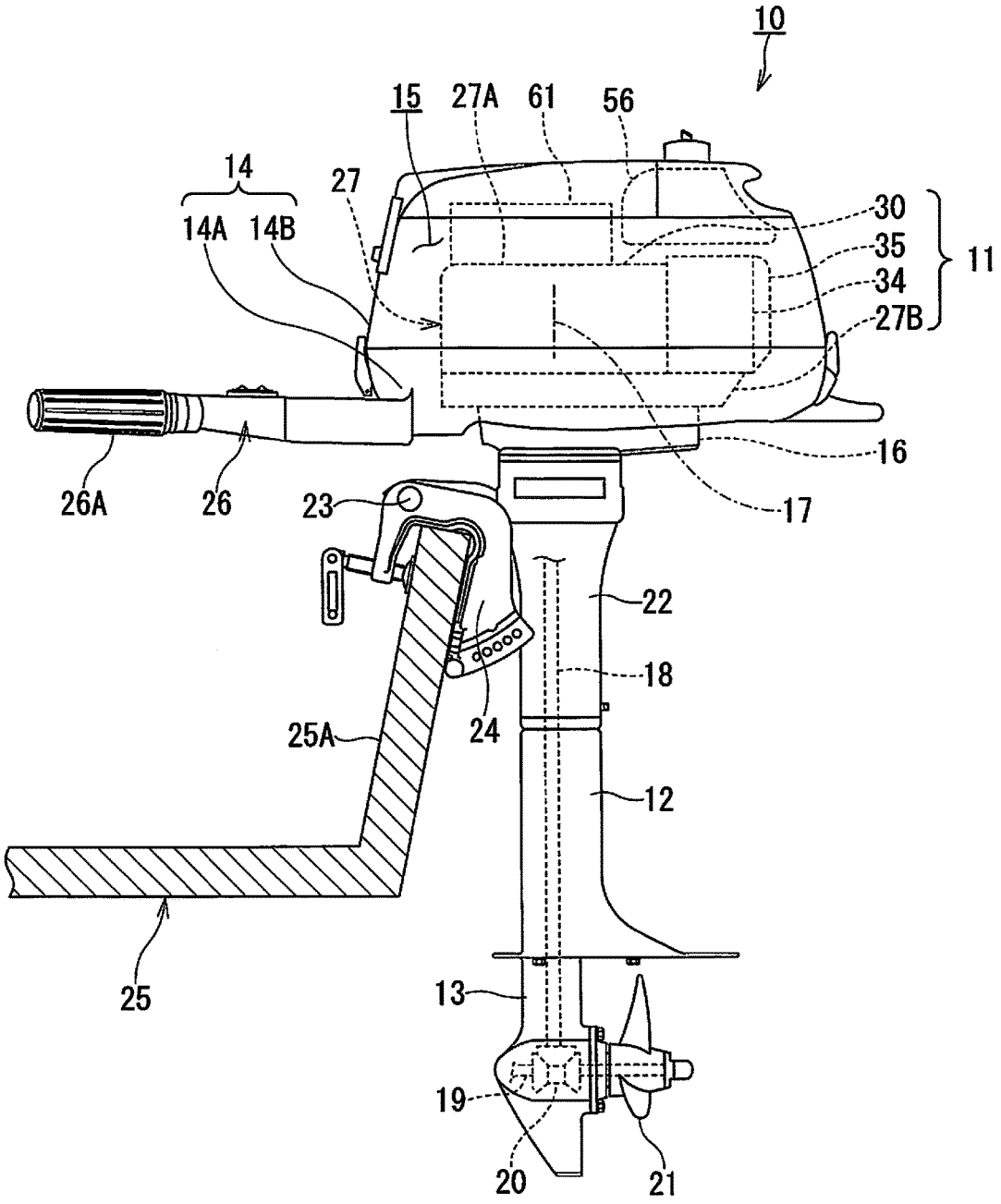
FIG. 1 is a left side view showing an outboard motor equipped with an engine applied in an embodiment of an engine breather apparatus according to an embodiment of the present invention.

FIG. 1 is a left side view showing an outboard motor equipped with an engine applied in an embodiment of an engine breather apparatus according to an embodiment of the present invention. The outboard motor 10 shown in FIG. 1 is equipped with an engine holder 16, on which a vertical engine 11 is mounted. A drive shaft housing 12 is mounted integrally on the engine holder 16, extending downward and a gear case 13 is installed in a lower end portion of the drive shaft housing 12. The engine 11 and engine holder 16 are placed in an engine room 15 formed by being covered with an engine cover 14. The engine cover 14 includes a lower cover 14A attached to the engine holder 16 and an upper cover 14B detachably attached to the lower cover 14A.

The engine 11 is a vertical type in which a crankshaft 17 (FIG. 2) is mounted in a vertical direction. A drive shaft 18 coupled to the crankshaft 17 extends in the vertical direction in the drive shaft housing 12. The drive shaft 18 is connected to a propeller shaft 19 disposed horizontally in the gear case 13, via a shift mechanism 20, and a propeller 21 is mounted integrally rotatably on a rear end portion of the propeller shaft 19. A driving force of the engine 11 is transmitted from the crankshaft 17 to the drive shaft 18 to the shift mechanism 20 and to the propeller shaft 19, turning the propeller 21 in a forward or reverse direction by the action of the shift mechanism 20 and thereby causing a hull 25 (described later) to move forward or backward.

An upper half of the drive shaft housing 12 is supported pivotally in a horizontal direction by a swivel bracket 22 provided around the drive shaft housing 12. The swivel bracket 22 is supported by a swivel shaft 23 pivotally in a vertical direction with respect to a clamp bracket 24, which grips a transom 25A of the hull 25. Since the swivel bracket 22 is installed pivotally in the vertical direction with respect to the clamp bracket 24, the outboard motor 10 is mounted on the hull 25 trimmably and tiltably in the vertical direction. Also, as the drive shaft housing 12 is installed pivotally in the horizontal direction with respect to the swivel bracket 22, the outboard motor 10 is installed steerably in the horizontal direction.

Note that in steering the outboard motor 10, a steering handle 26 is used. The steering handle 26 is pivotably supported by the engine holder 16 in the vertical direction and a throttle grip 26A for use to adjust output of the engine 11 is provided at a tip of the steering handle 26.

The engine 11 is, for example, a four-stroke single-cylinder engine of an OHV (Over Head Valve) type and includes a crankcase 27 made up of an upper crankcase half 27A and lower crankcase half 27B joined together splitably in an up-and-down direction. The lower crankcase half 27B of the crankcase 27 is fixedly supported by the engine holder 16. Also, as shown in FIGS. 3 and 4, an oil pan 28 adapted to reserve lubricating oil 1 is provided in the lower crankcase half 27B.

Figure 2:
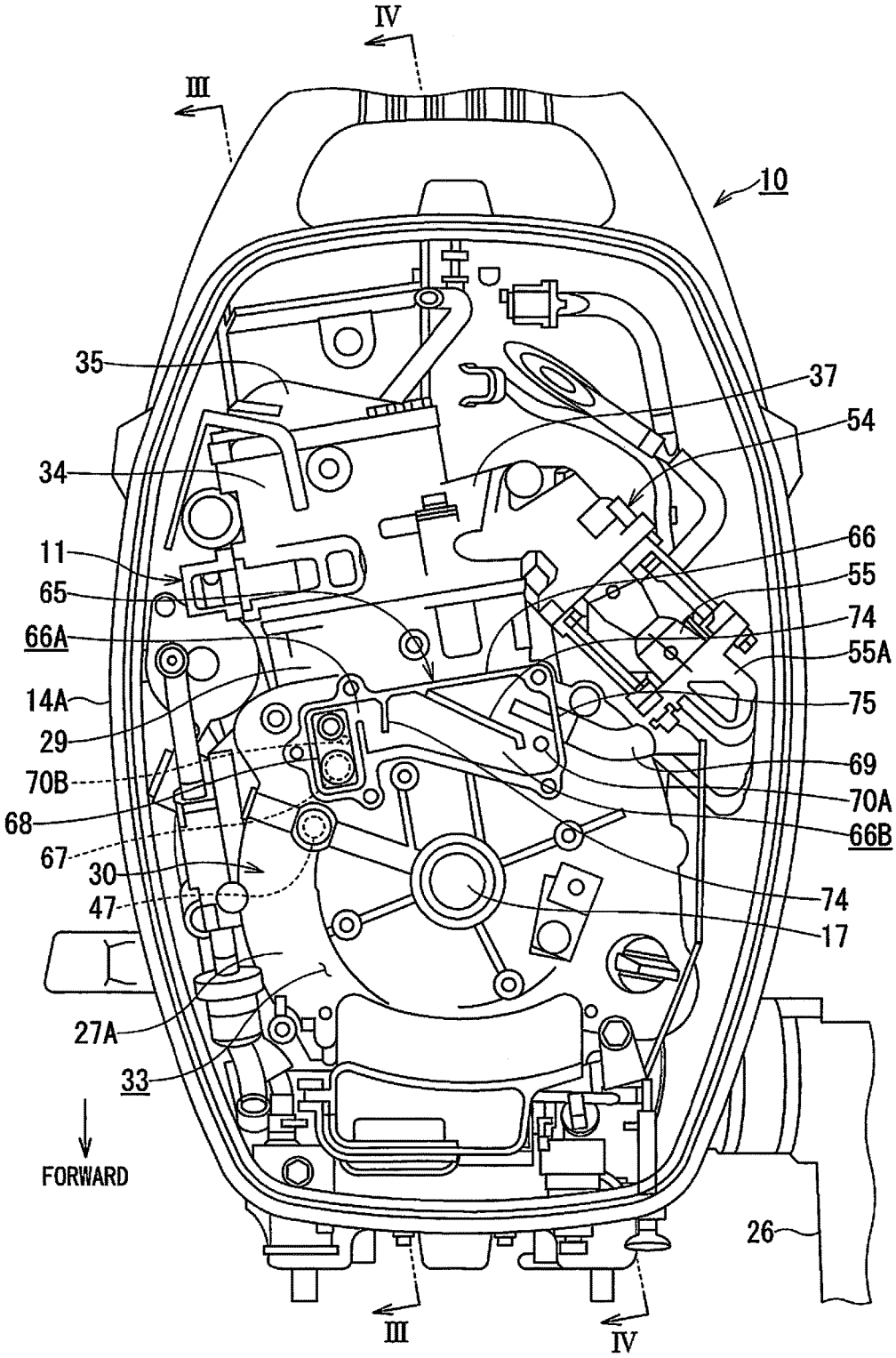
FIG. 2 is a plan view showing the outboard motor of FIG. 1 with an engine cover removed.
Figure 3:
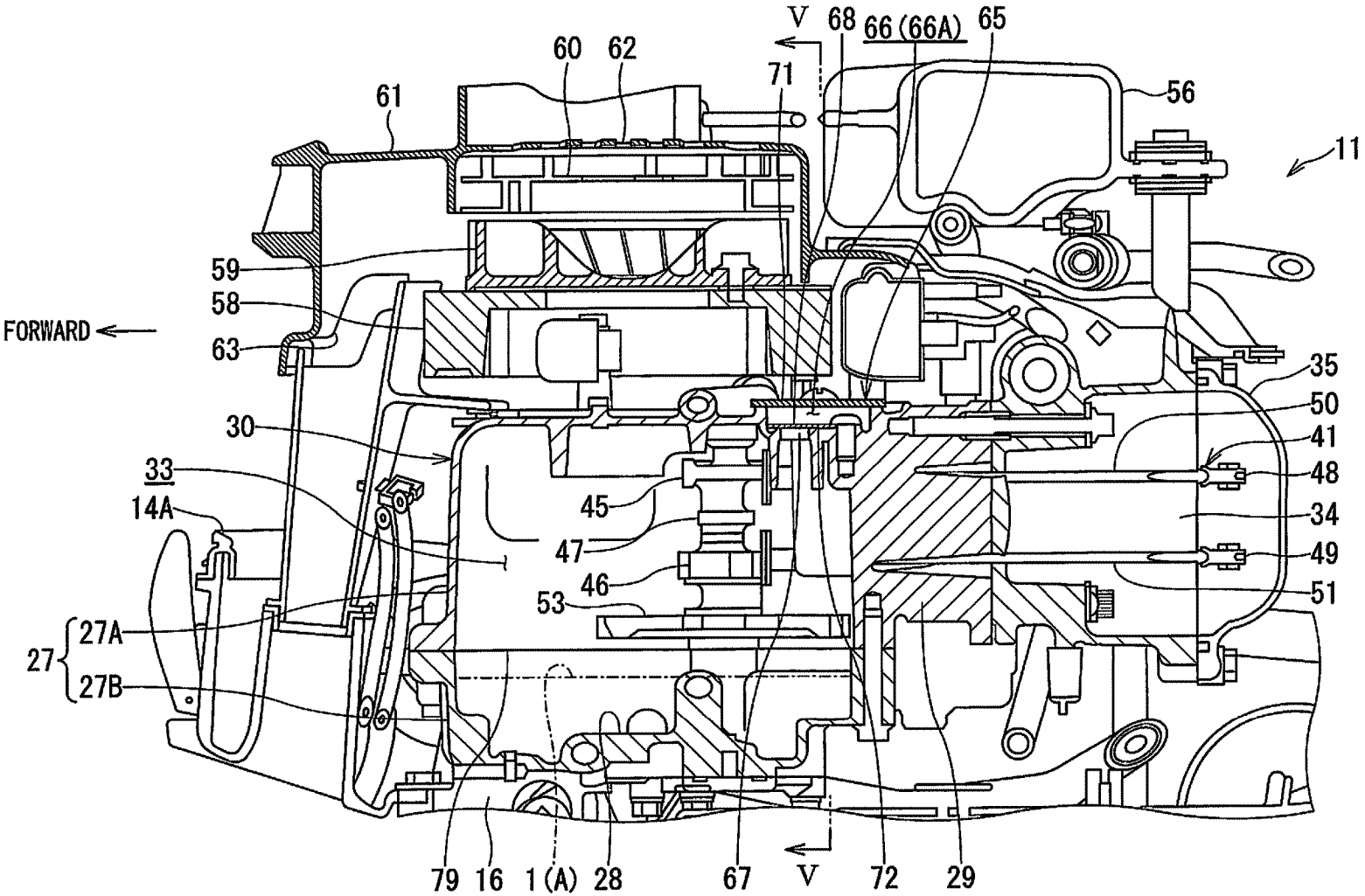
FIG. 3 is a sectional view taken along line III-III in FIG. 2.
Figure 4:
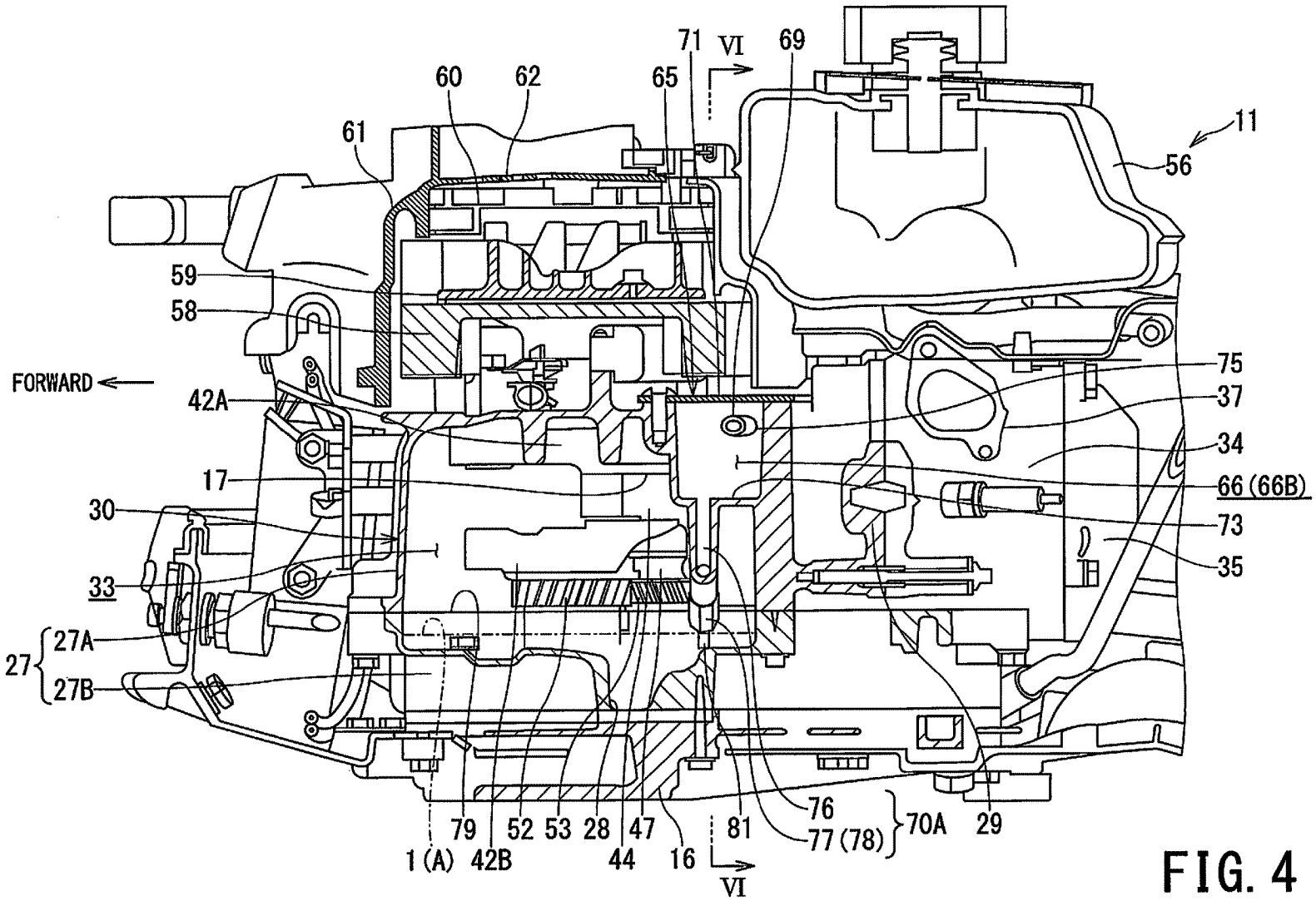
FIG. 4 is a sectional view taken along line IV-IV in FIG. 2.
Figure 5:
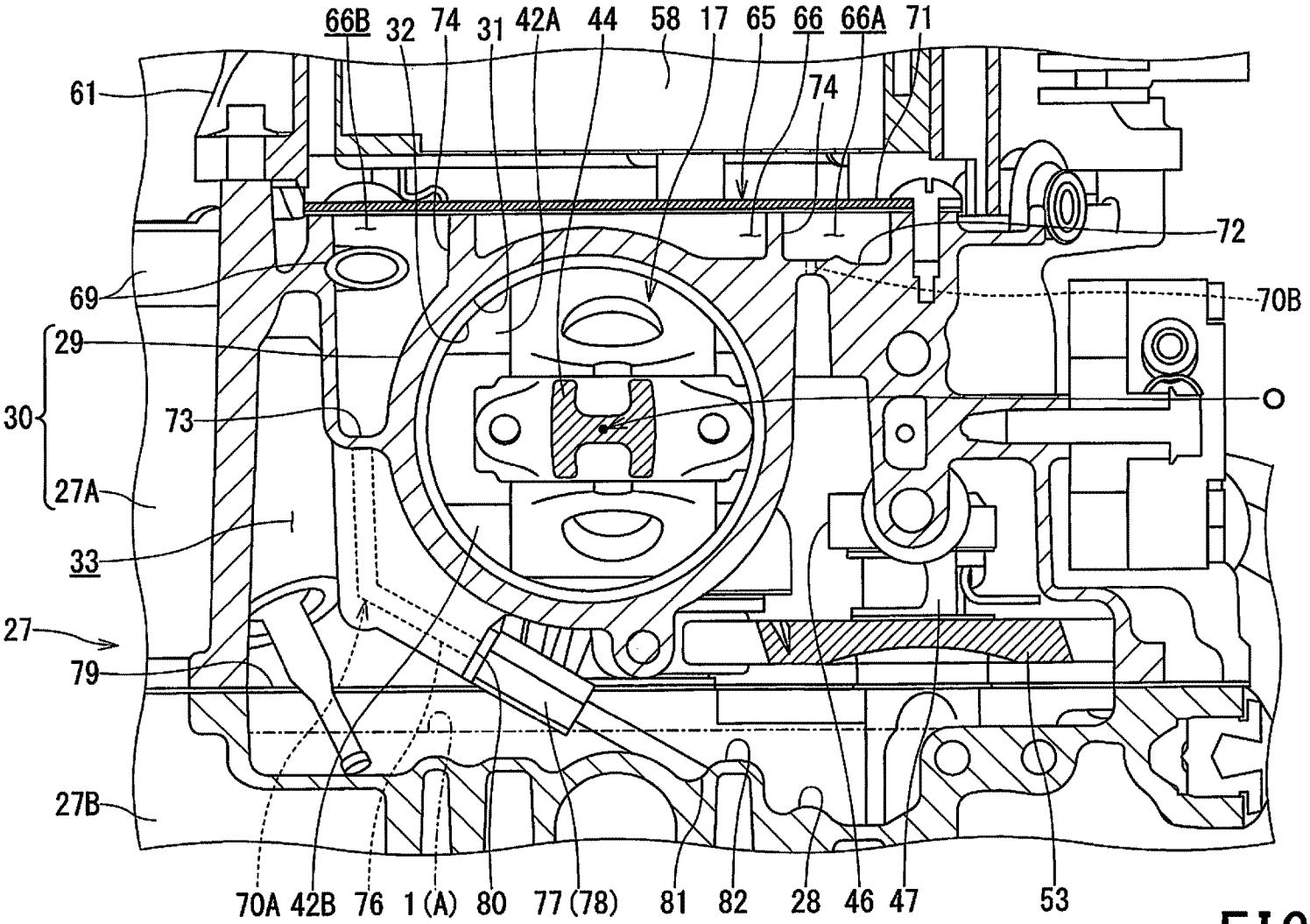
FIG. 5 is a sectional view taken along line V-V in FIG. 3.
Figure 6:
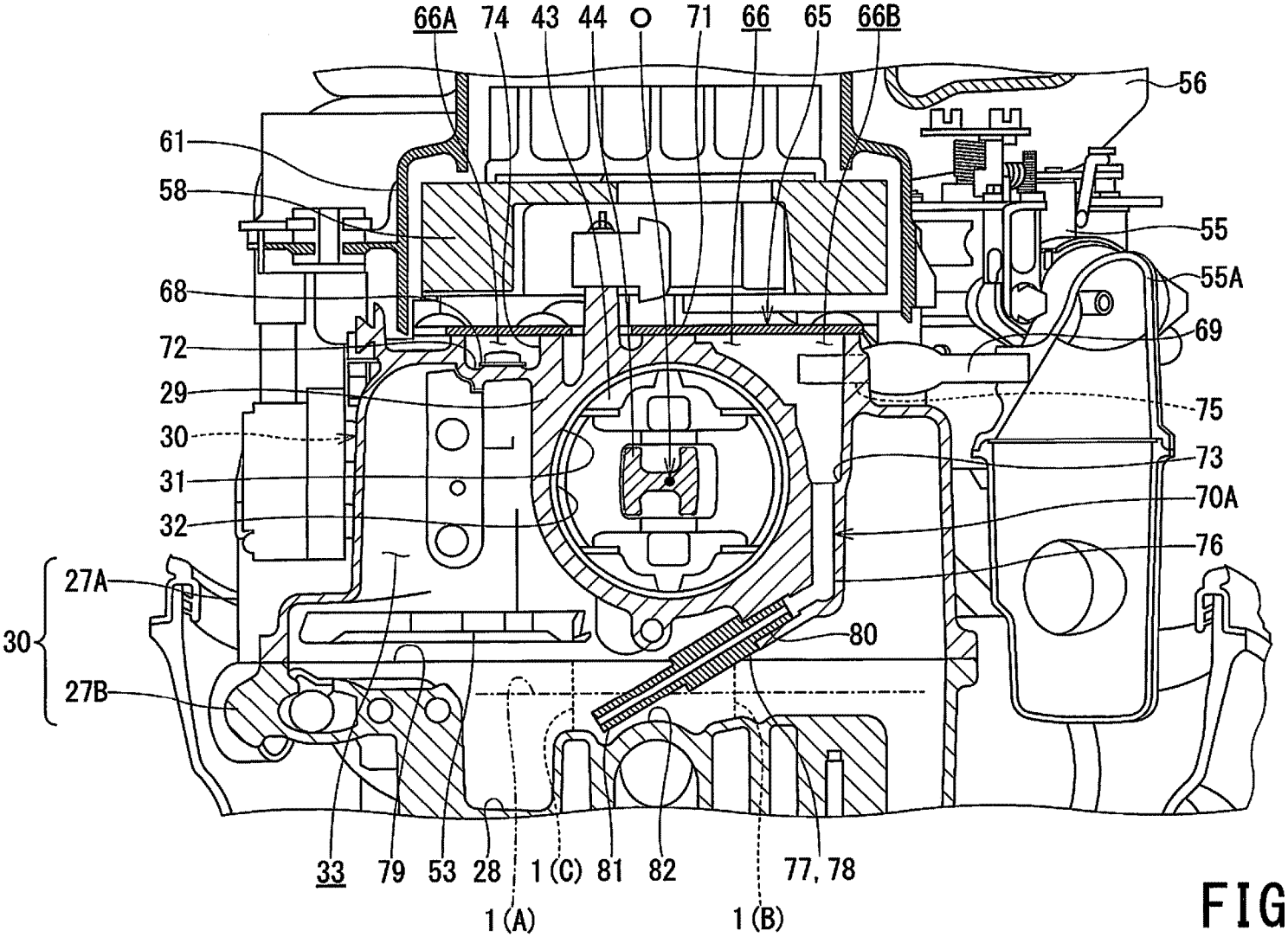
FIG. 6 is a sectional view taken along line VI-VI in FIG. 4.
Figure 7:
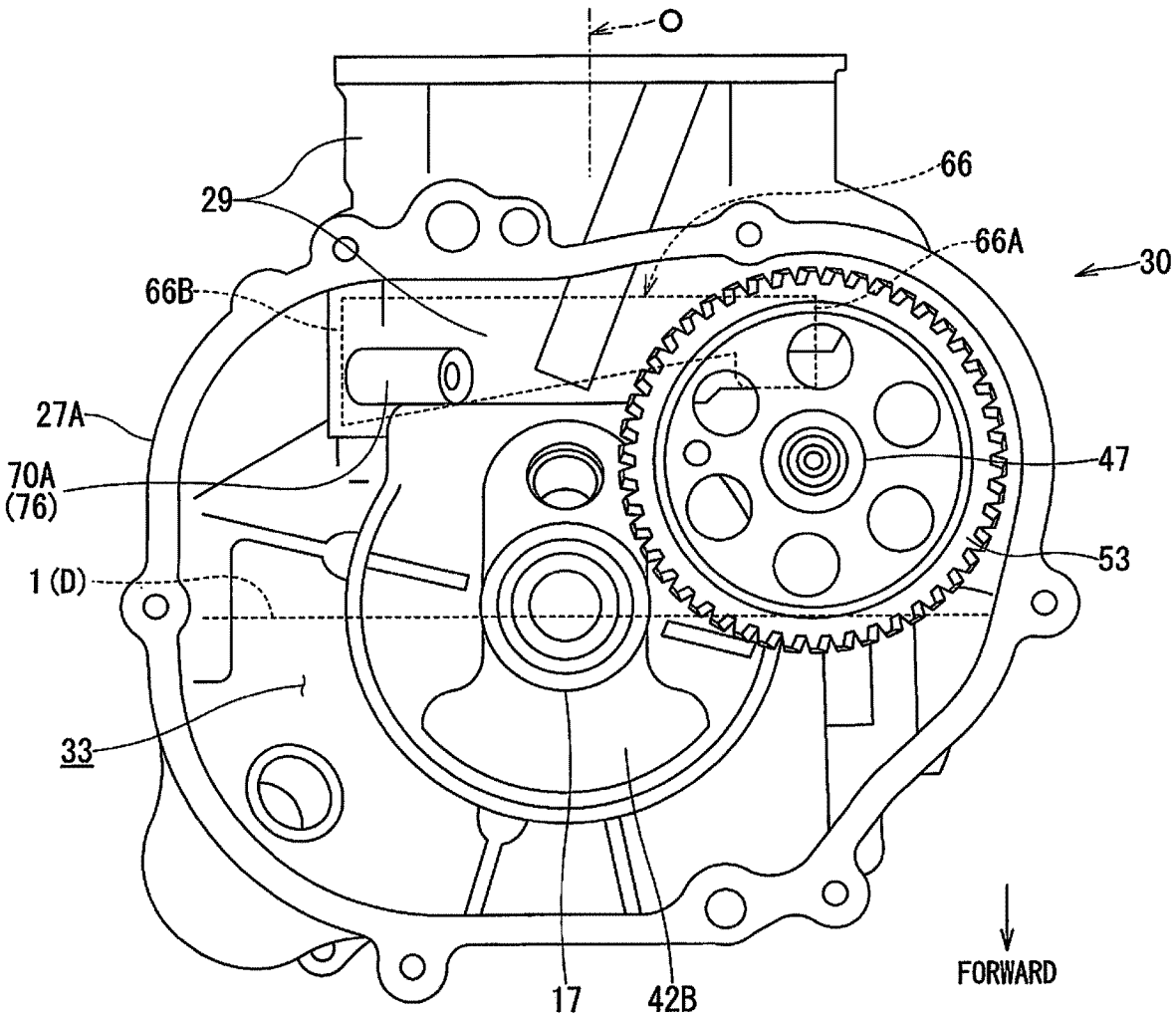
FIG. 7 is a bottom view of a cylinder block shown in FIG. 2.

As shown in FIGS. 2 to 4, the upper crankcase half 27A makes up the cylinder block 30 by being formed integrally with the cylinder 29. As shown in FIGS. 5 to 7, a cylinder bore 31 whose central axis O extends in the horizontal direction is formed in the cylinder 29, and a cylinder sleeve 32 is firmly fixed to an inner circumferential surface of the cylinder bore 31. Also, as shown in FIGS. 3 and 4, a crank chamber 33 adapted to house the crankshaft 17 in the vertical direction is formed by the upper crankcase half 27A and lower crankcase half 27B, and the crankshaft 17 is rotatably supported by the upper crankcase half 27A and lower crankcase half 27B. The crank chamber 33 is located in forward part of the engine 11 while the cylinder 29 is located in rearward part of the engine 11.

With this engine 11, a cylinder head 34 is installed at a rear end of the cylinder 29 and a head cover 35 is installed at a rear end of the cylinder head 34 in sequence. A non-illustrated combustion chamber which conforms to the cylinder bore 31 of the cylinder 29 is formed in the cylinder head 34. Furthermore, an intake port 37 and an exhaust port (not illustrated) communicated with the combustion chamber are formed in the cylinder head 34 and an intake valve and exhaust valve (neither is illustrated) adapted to open and close the intake port 37 and exhaust port are disposed in the cylinder head 34. The intake valve and exhaust valve open and close by being driven by a valve driving mechanism 41 (described later).

On the crankshaft 17 housed in the crank chamber 33, a pair of crank webs 42A and 42B are formed at an approximate center position in an axial direction by being spaced away from each other in the axial direction. Also, in the cylinder bore 31 of the cylinder 29, a piston 43 is slidably disposed via the cylinder sleeve 32. The piston 43 is coupled with the crank webs 42A and 42B of the crankshaft 17 via a connecting rod 44, and consequently reciprocating motion of the piston 43 in the cylinder bore 31 is converted into rotary motion of the crankshaft 17.

As shown in FIG. 3, the OHV valve driving mechanism 41 adapted to drive the intake valve and exhaust valve has a cam shaft 47 in the crank chamber 33, where the cam shaft 47 is equipped with an intake cam 45 and exhaust cam 46. The cam shaft 47 is placed in parallel to the crankshaft 17 (i.e., in the vertical direction) and rotatably supported by the upper crankcase half 27A and lower crankcase half 27B. Also, an intake-side locker arm 48 and exhaust-side locker arm 49 are swingably supported in the cylinder head 34, one end of the intake-side locker arm 48 abuts a valve stem of the intake valve while one end of the exhaust-side locker arm 49 abuts a valve stem of the exhaust valve. Another end of the intake-side locker arm 48 is operatively coupled to the intake cam 45 via an intake-side push rod 50 and another end of the exhaust-side locker arm 49 is operatively coupled to the exhaust cam 46 via an exhaust-side push rod 51.

As shown in FIGS. 3 and 4, a drive gear 52 is installed on the crankshaft 17 and a cam driven gear 53 is installed on the cam shaft 47. As the drive gear 52 and cam driven gear 53 mesh with each other, the cam shaft 47 rotates at a predetermined reduction ratio (e.g., 1/2) by a driving force of the crankshaft 17. As the cam shaft 47 rotates, the intake valve opens and closes via the intake cam 45, intake-side push rod 50, and intake-side locker arm 48 and the exhaust valve opens and closes via the exhaust cam 46, exhaust-side push rod 51, and exhaust-side locker arm 49, with predetermined timings in synchronization with the crankshaft 17.

The intake port 37 shown in FIGS. 2 and 4 is communicated with a carburetor 55 which makes up an intake system 54 of the engine 11. The carburetor 55 includes a suction port 55A, produces fuel-air mixture from air (intake air) taken into engine room 15 through the suction port 55A and fuel led from a fuel tank 56 and supplies the air-fuel mixture to a combustion chamber of the engine 11. As the fuel-air mixture burns in the combustion chamber, the piston 43 reciprocates in the cylinder bore 31 of the cylinder 29. A carburetor 55 is placed together with the suction port 55A in one side portion in a width direction of the engine 11, e.g., in a left side portion, in the engine room 15. Also, as shown in FIGS. 3 and 4, the fuel tank 56 is installed above the cylinder 29 and cylinder head 34 of the cylinder block 30.

A flywheel magnet 58 of a power generator is mounted integrally rotatably on an upper end of the crankshaft 17 in upper part of the engine 11 and a ventilation fan 59 is firmly fixed to upper part of the flywheel magnet 58. A recoil starter pulley 60, which is an engine starter, is installed above the ventilation fan 59 integrally rotatably with the crankshaft 17. The flywheel magnet 58, ventilation fan 59, and recoil starter pulley 60 are covered with a fan cover 61. An airflow inlet 62 is formed in an upper surface of the fan cover 61 and an airflow outlet 63 is formed in lower front part of the fan cover 61.

As shown in FIGS. 2, 5, 6, and 8, gas under pressure generated in the combustion chamber flows as blow-by gas into the crank chamber 33 through a clearance between the piston 43 and cylinder bore 31 (cylinder sleeve 32). Pressure of the blow-by gas in the crank chamber 33 constantly changes along with movement of the piston 43. Thus, the blow-by gas is led to the breather apparatus 65 in such a way that the pressure of the blow-by gas will not disturb movement of the piston 43. The breather apparatus 65 includes a breather chamber 66, a blow-by gas introduction hole 67, a one-way valve 68, a breather pipe 69, a first breather oil return passage 70A, and a second breather oil return passage 70B.

The breather chamber 66 is formed right under the flywheel magnet 58 in upper part of the cylinder block 30 in which the cylinder 29 and upper crankcase half 27A are constructed integrally. An upper opening of the breather chamber 66 is closed by a lid member 71. The breather chamber 66 is formed along substantially half a circumference of the cylinder bore 31 by straddling top part of the cylinder bore 31 of the cylinder 29 in a circumferential direction from one side to the other side. Consequently, the breather chamber 66 is constructed with one side portion 66A and the other side portion 66B in the circumferential direction of the cylinder bore 31 being communicated with each other.

The one side portion 66A of the breather chamber 66 is positioned on the side on which the cam shaft 47 of the valve driving mechanism 41 is installed. A bottom face 72 (FIGS. 3 and 6) of the one side portion 66A of the breather chamber 66 is provided at a level higher than the intake cam 45 and exhaust cam 46 of the cam shaft 47 (especially than the intake cam 45 located above the exhaust cam 46). This prevents splashes of lubricating oil produced by rotation of the cam shaft 47 from flying from the intake cam 45 and exhaust cam 46 (especially from the intake cam 45) and attaching to the bottom face 72 of the one side portion 66A of the breather chamber 66.

A bottom face 73 (FIGS. 4 and 5) of the other side portion 66B of the breather chamber 66 is provided by projecting into the crank chamber 33 to a level lower than a bottom face 72 of the one side portion 66A and contributes to increasing volume of the breather chamber 66. Furthermore, a buffer wall 74 is formed in the breather chamber 66 in order for the blow-by gas flowing through the breather chamber 66 to collide with. As the blow-by gas collides with the buffer wall 74, oil in the blow-by gas is separated.

As shown in FIGS. 2, 3, 6, and 8, being formed at an end of the one side portion 66A of the breather chamber 66, the blow-by gas introduction hole 67 communicates the crank chamber 33 and breather chamber 66 with each other and leads the blow-by gas in the crank chamber 33 to the breather chamber 66. Also, being installed at an end of the one side portion 66A of the breather chamber 66, the one-way valve 68 opens and closes the blow-by gas introduction hole 67 along with pulsating pressure in the crank chamber 33. That is, the one-way valve 68 is designed to open the blow-by gas introduction hole 67 during pressurization of the crank chamber 33 and close the blow-by gas introduction hole 67 during depressurization of the crank chamber 33. Furthermore, the second breather oil return passage 70B is formed in the one side portion 66A of the breather chamber 66 by communicating the breather chamber 66 and crank chamber 33 with each other and used to return the oil separated in the breather chamber 66 to the crank chamber 33 when the one-way valve 68 is closed.

Figure 8:
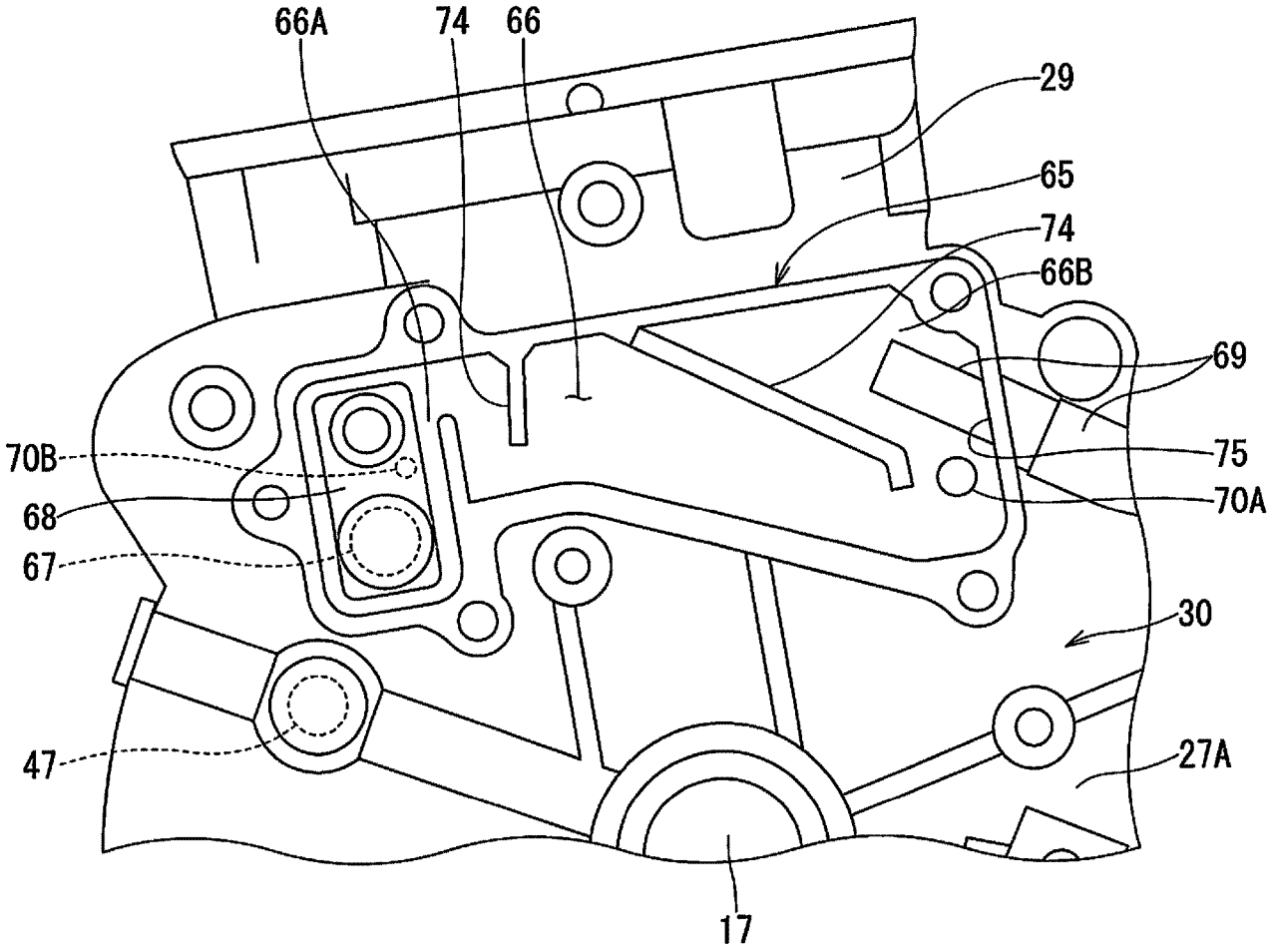
FIG. 8 is a partial plan view showing the breather apparatus of FIG. 2 and its surroundings in enlargement.

As shown in FIGS. 2, 6, and 8, the breather pipe 69 is communicated with the suction port 55A of the carburetor 55 and press-fitted in a pipe connection hole 75 formed in an end of the other side portion 66B of the breather chamber 66. By being press-fitted in the pipe connection hole 75, the breather pipe 69 is connected to the breather chamber 66 and thereby connected to the carburetor 55 of the intake system 54 of the engine 11 through the breather pipe 69. The blow-by gas from which oil has been separated in the breather chamber 66 is led to the carburetor 55 through the breather pipe 69.

As shown in FIGS. 2, 4 to 6, and 8, the first breather oil return passage 70A is formed in an end of the other side portion 66B of the breather chamber 66 and returns the oil separated in the breather chamber 66 to the crank chamber 33 by communicating the breather chamber 66 and crank chamber 33 with each other. The first breather oil return passage 70A includes a cylinder-side portion 76 formed along the cylinder bore 31 integrally with an outer circumference of the cylinder 29 an extending portion 77 extending out of the cylinder-side portion 76.

The extending portion 77 reaches lower part of the crank chamber 33 below oil level A of the lubricating oil 1 reserved in the oil pan 28 in the lower crankcase half 27B and extends to under the cylinder bore 31 and to the side of the one side portion 66A on an opposite side of a central axis O of the cylinder bore 31. Specifically, the extending portion 77 is a tubular member 78 separate from the cylinder 29 and detachable from the cylinder-side portion 76. The tubular member 78 extends to below the cylinder 29 and an approximate lower half of the tubular member 78 is located below a dividing plane 79 between the upper crankcase half 27A and lower crankcase half 27B. That is, a base end 80 of the tubular member 78 on an upper side is joined to the cylinder-side portion 76 of the upper crankcase half 27A by being inserted thereinto while a tip 81 on a lower side is positioned close to a bottom face 82 of the lower crankcase half 27B by being opposed thereto.

Next, operation of the breather apparatus 65 will be described mainly with reference to FIGS. 2, 5, 6, and 8.

During operation of the engine 11, the one-way valve 68 opens and closes the blow-by gas introduction hole 67 along with the pulsating pressure in the crank chamber 33 resulting from reciprocation of the piston 43, and consequently the blow-by gas from the crank chamber 33 flows into the one side portion 66A of the breather chamber 66 through the blow-by gas introduction hole 67. When the blow-by gas flowing into the one side portion 66A flows toward the other side portion 66B, flow path area decreases at a position directly above the central axis O of the cylinder bore 31, increasing flow velocity. When the blow-by gas reaches the other side portion 66B, the flow velocity decreases slowly as the flow path cross-sectional area increases gradually. Furthermore, while flowing from the one side portion 66A of the breather chamber 66 to the other side portion 66B, the blow-by gas collides with the buffer wall 74.

Oil is separated from the blow-by gas due to changes in the flow velocity and collision with the buffer wall 74 described above and the blow-by gas from which oil has been separated is supplied to the suction port 55A of the carburetor 55 through the breather pipe 69. Also, the oil separated from the blow-by gas is returned to the crank chamber 33 through the first breather oil return passage 70A and second breather oil return passage 70B.

Also, during storage of the outboard motor 10, if the outboard motor 10 is laid on its side with the other side portion 66B of the breather chamber 66 in the breather apparatus 65 of the engine 11 down, the lubricating oil in the crank chamber 33 attains oil level B indicated by a broken line in FIG. 6 and the blow-by gas introduction hole 67, the second breather oil return passage 70B, the first breather oil return passage 70A, and the tip 81 of the tubular member 78 are all located above oil level B of the lubricating oil 1. This prevents the lubricating oil 1 from flowing into the breather chamber 66 from the crank chamber 33 and thereby prevents the lubricating oil 1 from leaking outside.

Also, during storage of the outboard motor 10, if the outboard motor 10 is laid on its side with the one side portion 66A of the breather chamber 66 in the breather apparatus 65 of the engine 11 down, the lubricating oil in the crank chamber 33 attains oil level C indicated by a broken line in FIG. 6, and although the blow-by gas introduction hole 67 and second breather oil return passage 70B are placed below oil level C of the lubricating oil 1, at least the breather pipe 69 is located above oil level C. Consequently, the lubricating oil 1 flowing into the breather chamber 66 from the crank chamber 33 through the blow-by gas introduction hole 67 and second breather oil return passage 70B does not reach the breather pipe 69 and is prevented from leaking outside.

Furthermore, during storage of the outboard motor 10, if the outboard motor 10 is laid face down with that part of the cylinder block 30 which is on the side of the crank chamber 33 down, the lubricating oil in the crank chamber 33 attains oil level D indicated by a broken line in FIG. 7, and the blow-by gas introduction hole 67, the second breather oil return passage 70B, the first breather oil return passage 70A, and the tip 81 of the tubular member 78 are all located above oil level D of the lubricating oil 1. This prevents the lubricating oil 1 from flowing into the breather chamber 66 from the crank chamber 33 and thereby prevents the lubricating oil 1 from leaking outside.

Being configured as described above, the present embodiment provides the following advantages (1) to (7).

(1) As shown in FIGS. 3, 4 and 8, when the bottom face 72 of the one side portion 66A in the circumferential direction of the cylinder bore 31 in the breather chamber 66 of the breather apparatus 65 is approximately level with the intake cam 45 and exhaust cam 46 of the cam shaft 47, splashes (oil droplets) of the lubricating oil 1 in the crank chamber 33 attach to the bottom face 72 of the one side portion 66A of the breather chamber 66 by flying from the intake cam 45 and exhaust cam 46 under action of centrifugal force and tend to flow into the breather chamber 66 through the blow-by gas introduction hole 67 and second breather oil return passage 70B. Thus, the bottom face 72 of the one side portion 66A of the breather chamber 66 needs to be formed at a level higher than the intake cam 45 and exhaust cam 46.

In contrast, in the other side portion 66B of the breather chamber 66 in the circumferential direction of the cylinder bore 31, where splashes from the intake cam 45 and exhaust cam 46 are blocked by the cylinder 29 (FIG. 7) projecting into the crank chamber 33, even if the bottom face 73 of the other side portion 66B is extended to a position approximately level with or lower than the intake cam 45 and exhaust cam 46, splashes (oil droplets) of lubricating oil 1 in the crank chamber 33 will not attach to the bottom face 73 of the other side portion 66B of the breather chamber 66. Thus, as shown in FIGS. 5 and 6, when the bottom face 73 of the other side portion 66B of the breather chamber 66 is made to project into the crank chamber 33 to a level lower than the bottom face 72 of the one side portion 66A of the breather chamber 66, the volume of the breather chamber 66 can be increased as a whole and consequently gas/liquid separation performance in the breather chamber 66 can be improved.

(2) As shown in FIGS. 2, 5, 6, and 8, in the cylinder block 30, the one side portion 66A of the breather chamber 66 in the circumferential direction of the cylinder bore 31 is provided on the side on which the cam shaft 47 of the valve driving mechanism 41 is disposed while the other side portion 66B of the breather chamber 66 in the circumferential direction of the cylinder bore 31 is provided on a side opposite the side on which the cam shaft 47 is disposed. The one side portion 66A of the breather chamber 66 provided on the side of the cam shaft 47 needs to form the breather chamber by avoiding the cam shaft 47. This decreases space efficiency. In contrast, the other side portion 66B of the breather chamber 66 can form the breather chamber by projecting into the crank chamber 33 almost without constraints, and thereby allows efficient use of space in the crank chamber 33.

(3) As shown in FIGS. 3 and 8, since the bottom face 72 of the one side portion 66A of the breather chamber 66 in the circumferential direction of the cylinder bore 31 in the breather chamber 66 is provided above the intake cam 45 and exhaust cam 46 (especially the intake cam 45) on the cam shaft 47, it is possible to prevent splashes (oil droplets) of oil from the intake cam 45 and exhaust cam 46 (especially from the intake cam 45) from attaching to the bottom face 72 of the one side portion 66A. Consequently, it is possible to prevent the oil droplets attaching to the bottom face 72 of the one side portion 66A of the breather chamber 66 from flowing into the breather chamber 66 through the blow-by gas introduction hole 67 and second breather oil return passage 70B.

(4) As shown in FIGS. 4 to 6, the first breather oil return passage 70A adapted to return the oil separated in the breather chamber 66 of the breather apparatus 65 to the crank chamber 33 includes the cylinder-side portion 76 and extending portion 77 provided along the cylinder bore 31, and the extending portion 77 (tubular member 78) extends to below oil level A of the lubricating oil 1 reserved in the oil pan 28 in the lower part of the crank chamber 33. This prevents oil mist in the crank chamber 33 from flowing directly into the breather chamber 66 through the first breather oil return passage 70A.

(5) As shown in FIGS. 4 to 6, the first breather oil return passage 70A of the breather apparatus 65 includes the cylinder-side portion 76 and extending portion 77 (tubular member 78) provided along the cylinder bore 31 and the extending portion 77 extends to under the cylinder bore 31, i.e., to the side of the one side portion 66A on the opposite side of the central axis O of the cylinder bore 31. Thus, even if the engine 11 is stored, for example, by being laid on its side with the other side portion 66B of the breather chamber 66 down, the tip 81 of the extending portion 77 (tubular member 78) is higher than oil level B of the lubricating oil 1 in the crank chamber 33. This makes it possible to prevent the lubricating oil 1 from flowing into the breather chamber 66 through the extending portion 77 (tubular member 78) and leaking outside.

(6) As shown in FIGS. 4 to 6, the extending portion 77 of the first breather oil return passage 70A in the breather apparatus 65 is constructed from the detachable tubular member 78 separate from the cylinder 29 of the cylinder block 30. Consequently, the tubular member 78 projecting from the dividing plane 79 between the upper crankcase half 27A and lower crankcase half 27B can be removed from the first breather oil return passage 70A. This improves workability of the upper crankcase half 27A and lower crankcase half 27B in machining and thereby reduces cost. Furthermore, there is no need for the crankcase 27 to have a thick-walled structure in forming the extending portion 77, and thus the engine 11 can be reduced in weight.

(7) As shown in FIGS. 4 to 6, the tubular member 78 of the first breather oil return passage 70A in the breather apparatus 65 has its tip 81 positioned close to the bottom face 82 of the lower crankcase half 27B by being opposed thereto. Consequently, when coupling between the tubular member 78 and cylinder-side portion 76 becomes loose in the first breather oil return passage 70A, the tip 81 of the tubular member 78 abuts the bottom face 82 of the lower crankcase half 27B, restricting longitudinal movement of the tubular member 78 and thereby preventing the tubular member 78 from falling off into the crank chamber 33.

Whereas an embodiment of the present invention has been described, the embodiment is presented only by way of example, and not intended to limit the scope of the invention. The embodiment can be implemented in various other forms, and various omissions, replacements, and changes can be made without departing from the spirit of the invention.

What is claimed is:

1. A breather apparatus for an engine, wherein the engine includes a cylinder and a crankcase, wherein, in the cylinder, a cylinder bore is provided, which has a central axis that extends in a horizontal direction, wherein, in the crankcase, a crank chamber is configured to house a crankshaft in a vertical direction, the breather apparatus comprising:

a breather chamber formed, along substantially half a circumference of the cylinder bore, in a cylinder block in which the cylinder and the crankcase are constructed integrally, wherein one side portion of the breather chamber is formed in a circumferential direction of the cylinder bore, wherein the one side portion includes a blow-by gas introduction hole configured to lead blow-by gas in the crank chamber to the breather chamber, wherein the one side portion also includes a one-way valve configured to open and close the blow-by gas introduction hole along with pulsating pressure in the crank chamber, wherein the one side portion also includes a bottom face that projects into the crank chamber, wherein an other side portion of the breather chamber is formed in the circumferential direction of the cylinder bore, wherein the other side portion includes a pipe connection hole configured to connect a breather pipe communicating with an intake system to the breather chamber, wherein the other side portion also includes a breather oil return passage configured to return oil separated in the breather chamber to the crank chamber, wherein the other side portion includes a bottom face that projects into the crank chamber to a level lower than the bottom face of the one side portion of the breather chamber, and wherein, in the cylinder block, the one side portion of the breather chamber is positioned on an opposite side of the cylinder bore central axis from the other side portion of the breather chamber.

2. The breather apparatus of claim 1, wherein the engine is a four-stroke OHV engine in which a cam shaft of a valve driving mechanism is installed in the crank chamber and the one side portion of the breather chamber is positioned on a side on which the cam shaft is installed.

3. The breather apparatus of claim 2, wherein the bottom face of the one side portion of the breather chamber is provided above a cam on the cam shaft.

4. The breather apparatus of claim 1, wherein the breather chamber further comprises a buffer wall positioned in the breather chamber to collide with the blow-by gas flowing through the breather chamber.

5. The breather apparatus of claim 4, wherein, in response to the blow-by gas collides with the buffer wall, oil in the blow-by gas is separated therefrom.

6. The breather apparatus of claim 1, wherein the blow-by gas flowing into the one side portion flows toward the other side portion and a flow path area decreases at a position directly above the central axis of the cylinder bore, thereby increasing flow velocity.

7. The breather apparatus of claim 6, wherein, when the blow-by gas reaches the other side portion, the flow velocity decreases as the flow path cross-sectional area increases.

* * * * *